United States Patent [19]

Mark

[11] Patent Number: 4,488,881

[45] Date of Patent: Dec. 18, 1984

[54] COAL-AQUEOUS MIXTURES HAVING A PARTICULAR COAL PARTICLE SIZE DISTRIBUTION

[75] Inventor: Seymour Mark, Northampton, Pa.

[73] Assignee: The Standard Oil Company, Cleveland, Ohio

[21] Appl. No.: 495,627

[22] Filed: May 18, 1983

Related U.S. Application Data

[63] Continuation-in-part of Ser. No. 416,606, Sep. 10, 1982, , which is a continuation-in-part of Ser. No. 230,062, Jan. 29, 1981, Pat. No. 4,358,293.

[51] Int. Cl.[3] ..... C10L 1/32

[52] U.S. Cl. ..... 44/51; 44/77; 44/72; 252/351; 252/DIG. 1

[58] Field of Search ..... 44/51, 77, 72; 252/351, 252/DIG. 1

[56] References Cited

U.S. PATENT DOCUMENTS

| | | | |
|---|---|---|---|
| 3,762,887 | 10/1973 | Clancey et al. . | |
| 4,255,156 | 3/1981 | Sun et al. | 44/1 SR |
| 4,358,293 | 11/1982 | Mark | 44/51 |
| 4,392,865 | 7/1983 | Grosse et al. . | |

FOREIGN PATENT DOCUMENTS

| | | |
|---|---|---|
| 1523193 | 8/1976 | United Kingdom . |
| 2099451 | 12/1982 | United Kingdom . |

OTHER PUBLICATIONS

Development and Evaluation of Highly-Loaded Coal Slurries, Second International Symposium of Coal-Oil Mixture Combustion, Nov. 27-29, 1979.

*Primary Examiner*—Jacqueline V. Howard
*Attorney, Agent, or Firm*—Scully, Scott, Murphy & Presser

[57] ABSTRACT

Coal-aqueous mixtures comprising coal having a specified particle size distribution are disclosed herein.

15 Claims, No Drawings

COAL-AQUEOUS MIXTURES HAVING A PARTICULAR COAL PARTICLE SIZE DISTRIBUTION

CROSS-REFERENCE TO RELATED APPLICATIONS

This application is a continuation-in-part of U.S. application Ser. No. 416,606 filed Sept. 10, 1982 which in turn is a continuation-in-part of U.S. application Ser. No. 230,062 filed Jan. 29, 1981, (now U.S. Pat. No. 4,358,293) the entire contents of which are incorporated by reference herein.

BACKGROUND OF THE INVENTION

The present invention relates to the dispersion of carbonaceous materials and more particularly to coal-aqueous coal mixtures.

Coal as an energy source is in abundant supply. It is estimated that in the United States there is more energy available in coal than in petroleum, natural gas, oil shale and tar sands combined. The substitution of coal for natural gas and oil on a large scale would therefore seem a ready-made solution to our energy problems. Unfortunately, however, unlike oil and gas consumption, coal use is limited not by reserves or production capacity but rather by the extraordinary industrial and regulatory difficulties of burning it in a convenient, efficient and environmentally acceptable manner.

A number of techniques are being explored to provide coal as a more useful energy source. One such technique employs gasification methods such as destructive distillation, to effect the conversion of coal to a low or medium Btu gas. In another approach, high pressure hydrogenation is utilized to liquefy coal to make it more suited for transport, burning and the like.

Another technique suggested, and the one to which the present invention relates, is the technique whereby solid coal particles are dispersed in a fluid carrier medium, such as fuel oil or water to form coal-aqueous or coal-oil mixtures.

Coal-oil and coal-aqueous mixtures, however, are distinct systems, each having its own difficulties of formulation. For example, while coal and oil are relatively compatible, coal and water are not. Thus, unlike in the formulation of coal-oil admixtures, in the formulation of coal-aqueous admixtures, the initial dispersing of the coal in the continuous water phase, especially large amounts of coal, represents a challenging obstacle. Moreover, after dispersion, stabilizing, i.e. keeping the coal from settling out of the water phase, must be also achieved.

Such coal mixtures offer considerable advantages. They are more readily transported then dry solid coal, are more easily stored and are less subject to the risks of explosion by spontaneous ignition, the latter being a significant factor in handling coal. In addition, providing coal in a fluid form can permit its burning in apparatus normally used for burning fuel oil. This can greatly facilitate the transition from fuel oil to coal as a primary energy source, another highly desirable result.

Various coal-oil and coal-aqueous mixtures have been described in the literature. For example, British Pat. No. 1,523,193 discloses a mixture comprised of fuel oil and from 15 to 55% by weight of finely ground coal particles reduced in particle size to 10 microns or finer. The use of fuel oil as a carrier medium negates the requirement of lessening our dependence upon fuel oil.

In U.S. Pat. No. 3,762,887, there is disclosed a dispersion of coal in an aqueous medium wherein the coal is ground to a defined array of particle sizes, a substantial portion of which being about 325 mesh Tyler Standard screen or even finer.

The article titled "Development and Evaluation of Highly-Loaded Coal Slurries" published in the *2nd International Symposium on Coal-Oil Mixture Combustion,* Nov. 27-29, 1979, teaches coal-aqueous mixtures using coal of bimodal particle size distributions and containing modified starches, biocides and a wetting agent such as TRITON X, an octylphenoxy (ethyleneoxy) ethanol surfactant of low molecular weight.

British patent application GB 2 099 451A discloses aqueous coal suspensions which contain two separate groups of coal particles, the particles of the first group having an average size of from 210 to 60 μm, the maximum size not exceeding 300 μm and the particles of the second group having an average size of from 1/6 to 1/20 of the average size of the partices of the first group.

While the art has attempted to provide coal in dispersed fluid form, as evidenced by the above-described procedures, there still remains the need for improving these methods in order to provide higher solids and more stable coal mixtures. It would be highly desirable to provide coal in aqueous mixture form wherein only minor amounts of additive materials are needed to disperse the coal to high solids concentrations of 70% by weight, or higher. It would be further desirable to provide coal-aqueous mixtures wherein the coal is precleaned of impurities so that the resultant mixtures are clean burning or relatively clean burning and thus more environmentally acceptable.

SUMMARY OF THE INVENTION

Accordingly, it is one object of the present invention to provide dispersions of coal in a carrier medium.

It is another object of the present invention to provide coal-aqueous mixtures of high coal solids content.

It is a further object of the invention to provide coal-aqueous mixtures of high solids content wherein only minor amounts of additive materials are needed.

It is still a further object of the invention to provide coal-aqueous mixtures wherein the dispersed coal is precleaned of impurities so that the resultant mixtures are clean-burning or relatively clean-burning.

A further object of the invention is to provide suitable methods for forming coal-aqueous mixtures.

These and other objects will become apparent from the accompanying detailed description.

DETAILED DESCRIPTION OF THE INVENTION

U.S. Ser. No. 230,062 filed Jan. 29, 1981 (now U.S. Pat. No. 4,358,293) incorporated herein by reference, discloses the surprising discovery that certain polyalkyleneoxide nonionic surfactants are excellent additives for forming coal-aqueous mixtures having high coal solids concentrations. It is also disclosed therein that polyalkyleneoxide nonionic surfactants of high molecular weight having a hydrophobic portion and a hydrophilic portion, the hydrophilic portion being comprised of at least about 100 ethylene oxide repeating units, provide coal-water dispersions having very high coal solids concentrations of about 70% by weight coal, or higher, when the surfactant is present in an amount sufficient to disperse the particulate coal in water. The resultant mixtures are free-flowing and are adapted to provide coal in a form ready for transport, storate and clean-burning. Surprisingly, the surfactants employed can differ in chemical structure so long as they are of the selected type, are of sufficient molecular weight and are comprised of at least about 100 units of ethylene oxide.

It has now been surprisingly discovered that by increasing the content of the coarse fraction of coal particles, in the preparation of the coal-aqueous slurries disclosed in the afore-mentioned U.S. application Ser. No. 230,062, (now U.S. Pat. No. 4,358,293) even more improved coal-aqueous slurries are provided. For example, the coal slurries prepared in accordance with the present invention are characterized by even higher solids content, excellent long term storage stability and other advantages which will become apparent hereinafter.

The coal-aqueous slurries of the present invention are comprised of coal or other carbonaceous particulate material as the dispersed solid; water as the carrier medium; and a polyalkyleneoxide nonionic surfactant, as further described herein.

As used herein "polyalkyleneoxide nonionic surfactant" connotes all compositions, compounds, mixtures, polymers, etc. having in part an alkylene oxide repeating unit of the structure:

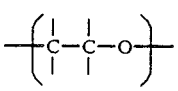

and having a hydrophobic portion and a hydrophilic portion and which does not dissociate or ionize in solution. These surfactants have a polymeric portion comprised of repeating units of ethylene oxide of the general formula:

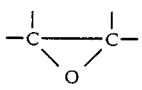

Moreover, the polyalkyleneoxide nonionic surfactant compositions employed in this invention are of high molecular weight, i.e., from about 4,000 or higher, depending on the particular surfactant employed, are hydrophilic and are comprised of at least about 100 repeating units of the ethylene oxide. In addition, the surfactants utilized have a hydrophobic portion and a hydrophilic portion and are nonionic. Being nonionic, these compositions are generally not subject to ionization in aqueous solutions of acid or alkali.

Suitable hydrophilic polyalkyleneoxide nonionic surfactants for use in this invention are the commercially available glycol ethers of alkyl phenols of the following general formula I:

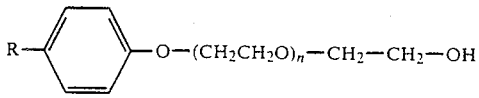

wherein R is substituted or unsubstituted alkyl of from 1 to 18 carbon atoms, preferably 9 carbon atoms; substituted or unsubstituted aryl, or an amino group and n is an integer of at least about 100.

These nonionic surfactants are available in a wide array of molecular weights depending primarily on the value of "n", i.e., the number of ethylene oxide repeating units. Surprisingly, it has been found that these surfactants of a high molecular weight of about 4,000 or higher wherein "n" is at least 100, or higher are particularly effective as dispersants for forming coal-aqueous mixtures to high coal solids concentration requiring little if any further additives, etc., to form highly flowable liquids.

Procedures for the preparation of the glycol ethers of formula I are well known and are described, for example, in U.S. Pat. Nos. 2,213,477 and 2,496,582, which disclosures are incorporated herein by reference. Generally, the production of these compositions involves the addition of substituted phenols with molar porportions of ethylene oxide monomer.

Thus, polyalkyleneoxide nonionic surfactants suitable for use in the invention include the glycol ethers of alkylated phenols having a molecular weight of at least about 4,000 of the general formula:

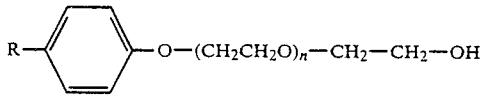

wherein R is substituted or unsubstituted alkyl of from 1 to 18 carbon atoms, preferably 9 carbon atoms; substituted or unsubstituted aryl, or an amino group, and n is an integer of at least about 100. The substituents of the alkyl and aryl radicals can include halogen, hydroxy, and the like.

Other suitable nonionic surfactants are the poly(oxyethylene)-poly(oxypropylene)-poly(oxyethylene) or, as otherwise described, propoxylated, ethoxylated propylene glycol nonionic surfactant block polymers having a molecular weight of at least about 6,000 of the general formula:

$$HO(CH_2CH_2O)_a[CH(CH_3)CH_2O]_b(CH_2CH_2O)_cH$$

wherein a, b and c are whole integers and wherein a and c total at least about 100.

Still other polyalkyleneoxide nonionic surfactants suitable for use in the invention are the block polymers of ethylene and propylene oxide derived from nitrogen-containing compositions such as ethylene diamine and having a molecular weight of at least about 14,000 of the general formula:

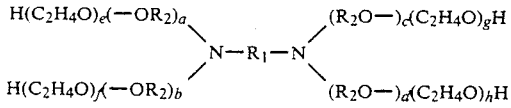

wherein $R_1$ is an alkylene radical having 2 to 5 carbon atoms, preferably 2; $R_2$ is alkylene radical having 3 to 5 carbon atoms, preferably 3; a, b, c, d, e, f, g and h are whole integers; and e, f, g and h total at least about 100.

The coal-aqueous mixture compositions of the invention herein are characterized by having a high coal content and a relatively low viscosity of about 2,000 or lower to in excess of 6,000 centipoise (cP) e.g. as measured in a Brookfield viscometer, model #RVT, fitted with a number 3 spindle, at 100 r.p.m. even at solids levels of 70% by weight, or higher, based on the total weight of the mixture. These compositions can also include amounts of conventional flow modifying materials, such as thickeners, glues, defoaming agents, salts, etc., depending upon the use intended.

The products of the invention contain only minor amounts of surfactant additives in the order of about 0.1 to 3.0 percent by weight. They further contain particulate coal as the dispersed solid in an amount from about 45 to 80 percent; water as the carrier medium in an amount of from about 19.9 to 52 percent and, if desired, from about 0.1 to 2 percent of a thickener or thickeners; about 0.01 to 2 percent of a defoaming agent and about 0.1 to 2 percent of salts, anti-bacterial agents, caustic or other additive flow control agents, all of the percentages given being based on the total weight of the mixture.

The most preferred glycol ethers of the type generally describe in formula I are the nonylphenoxy (polyethyleneoxy) ethanol compositions of the formula:

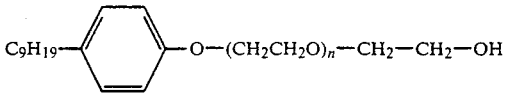

wherein n is about 100 or higher.

Commercially available surfactants of this type are supplied by the GAF Corporation under the designations IGEPAL CO-990 and IGEPAL CO-997. Other commercially available surfactants of this type are supplied by the Thompson-Hayward Chemical Co. under the designation T-Det N-100, and Whitestone Chemical Co. under the designation ICONOL NP-100.

As stated hereinbefore, another group of polyalkyleneoxide nonionic surfactants useful in the invention are the well known poly(oxyethylene)-poly(oxypropylene)-poly(oxyethylene) nonionic surfactant block polymers. These surfactants comprise the block polymers of ethylene oxide and propylene oxide with the repeating units of propylene oxide constituting the hydrophobic portion of the surfactant, and the repeating units of ethylene oxide constituting the hydrophilic portion of the surfactant. These block polymer compositions are of the general formula II:

$$HO(CH_2CH_2O)_a[CH(CH_3)CH_2O]_b(CH_2CH_2O)_cH \qquad \text{II}$$

wherein a, b and c are whole integers and wherein a and c total at least about 100.

These compositions can be prepared, and are commercially available, in a variety of molecular weights, depending primarily on the number of repeating units of propylene and ethylene oxide. It has been found that these block polymers having a molecular weight of at least about 6,000 and comprising at least about 100 repeating units of ethylene oxide are excellent additives for dispersing coal in a water carrier to the desired high coal solids concentrations of about 45 to 80 percent, preferably about 70 percent coal particles, based on the weight of the total mixture. Thus, with reference to the above formula II, the poly(oxyethylene)-poly(oxypropylene)poly (oxyethylene) nonionic surfactants suitable for use in the invention are those wherein a, b and c are integers and a and c total about 100 or higher.

Suitable procedures for the production of the block polymers of Formula II are described in the patent literature in, for example, U.S. Pat. Nos. 2,674,619; 2,677,700 and 3,101,374, which are incorporated herein by reference.

Generally, these block polymers are prepared by a controlled addition of propylene oxide to the two hydroxyl groups of propylene glycol to form the hydrophobe, followed by the controlled addition of ethylene oxide to "sandwich" in the hydrophobe between the two hydrophilic polyethyleneoxide groups.

The nonionic surfactants of this type (Formula II) having the requisite number of at least 100 units of ethylene oxide are available from the BASF-Wyandotte Corporation under the PLURONIC designation, Series Nos. F-77, F-87, F-68, F-88, F-127, F-98, and F-108. These compositions have at least 100 ethylene oxide units, as per the following table of these PLURONIC surfactants:

| PLURONIC F | Mol. Wt. | % Ethylene Oxide | Number of Ethylene Oxide Units |
|---|---|---|---|
| F-77 | 6,600 | 70 | 105 |
| F-87 | 7,700 | 70 | 120 |
| F-68 | 8,350 | 80 | 151 |
| F-88 | 10,800 | 80 | 195 |
| F-127 | 12,500 | 70 | 200 |
| F-98 | 13,000 | 80 | 235 |
| F-108 | 14,000 | 80 | 255 |

As also described hereinbefore, a further group of polyalkyleneoxide nonionic surfactants suitable as coal dispersants herein are the nitrogen containing block polymers of the general formula III:

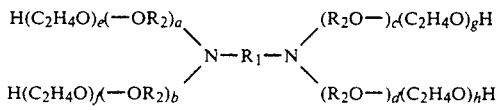

wherein $R_1$ is an alkylene radical having 2 to 5 carbon atoms, preferably 2; $R_2$ is an alkylene radical having 3 to 5 carbon atoms, preferably 3; a, b, c, d, e, f, g and h are whole integers; and e, f, g and h total at least about 100.

These materials are prepared by the addition of a $C_3$ to $C_5$ alkylene oxide to an alkylene diamine under conditions to add two polyoxyalkylene groups to each of the nitrogen groups in the presence of a catalyst so as to polymerize the oxyalkylene groups into the desired long-chained polyoxyalkylene radicals. After the desired addition and polymerization of the $C_3$ to $C_5$ alkylene oxide group has been completed, ethylene oxide is introduced and is added to the polyoxyalkylene groups to impart the desired hydrophilic characteristics to the compound. The preparation of these materials from commercially available alkylene diamines and alkylene oxides is known in the art.

In general, the agents are prepared by mixing the $C_3$ to $C_5$ alkylene oxide with the alkylene diamine at atmospheric or elevated pressures, at temperatures between about 50° to 150° centigrade and in the presence of an alkaline catalyst such as an alkali metal hydroxide or alcoholate. The degree of polymerization or the size of the hydrophobic group is controlled by the relative proportions of $C_3$ to $C_5$ alkylene oxide and alkylene diamine, the alkylene oxide being introduced in a sufficient quantity to obtain a hydrophobic base weight of about 2000 to 3600 units although other weights can be provided.

These surfactants (Formula III) having the requisite number of at least 100 ethylene oxide repeating units are available from the BASF Wyandotte Chemicals Corporation under the TETRONIC designations Series Nos. 1107; 1307; 908 and 1508. These compositions have at least 100 ethylene oxide units, as per the following table of these TETRONIC surfactants.

| TETRONIC | Mol. Wt. | % Ethylene Oxide | Number of Ethylene Oxide Repeating Units |
|---|---|---|---|
| 1107 | 14,500 | 70 | 230 |
| 1307 | 15,500 | 70 | 245 |
| 908 | 16,500 | 80 | 300 |
| 1508 | 17,000 | 80 | 309 |

In accordance with the present invention, it has now been surprisingly discovered that by increasing the content of the coarse fraction (−60 to +100 mesh) of the coal particles used to make-up the coal slurry, higher solids content are achieved. Thus, in accordance with the invention herein it has been found that the following size consist, i.e., coal particle size distribution will provide higher solids slurries at improved fluidity:

| mesh (Tyler Standard screen size) | % by weight of dry coal particle blend |
|---|---|
| −60, +100 | 5–20 |
| −100, +200 | 15–30 |
| −200, +325 | 15–30 |
| −325 | 30–50 |

A preferred coal particle distribution in accordance with the present invention is as follows:

| mesh (Tyler Standard screen size) | % by weight of coal particle blend |
|---|---|
| −60, +100 | 15–20 |
| −100, +200 | 20–25 |
| −200, +325 | 20–25 |
| −325 | 30–40 |

By the above designations, for example −60, +100 is meant that the particles in this fraction pass through 60 mesh screen size but not through 100 mesh screen size; thus −100, +200 means the particles in this fraction pass through 100 mesh screen size but not through 200 mesh screen size; −200, +325, the particles in this fraction pass through 200 mesh screen size but not 325; −325, all these particles pass through 325 mesh. Thus, particles in the fraction −60, +100 range in sizes from about 149 microns to greater than about 250 microns; the particles in the fraction −100, +200, range in size from about 74 microns to less than about 149 microns; in the fraction −200, +325, the particles range in size from 44 microns to less than about 74 microns; −325 fraction the particles are less than 44 microns.

Any of a wide array of coals can be used to form the coal-aqueous mixtures of the invention, including anthracite, bituminous, sub-bituminous, mine tailings, fines, lignite and the like. Other finely divided solid carbonaceous materials may also be used, e.g., coke, prepared either from coal or from petroleum.

To form the coal-aqueous mixtures, coal is pulverized by conventional procedures and the appropriate particle distribution is achieved by the use of U.S. mesh sieves and blending the various fractions.

Advantageously, according to the invention, the untreated pulverized raw coal, has been beneficiated, i.e., cleaned of amounts of ash and sulfur. The art will appreciate that mixtures formed of beneficiated coal offer considerable advantage. They are clean burning or relatively clean burning, and are more suited for burning in apparatus for powering utilities, home burners and the like without undue burdensome and expensive cleaning apparatus.

Any of a wide array of beneficiating treatments can be employed in preparing the particulate coals, including conventional heavy-media separations, magnetic separation and the like. The preferred method for providing the beneficiated coal particles is by a chemical treatment process such as described in U.S. Pat. No. 4,304,573.

Generally, according to the preferred chemical beneficiation treatment method, raw as-mined coal is ground in the presence of water to the desired particle sizes. The ground coal is treated in an aqueous medium with a monomeric compound, generally an unsaturated polymerizable composition such as readily available tall oil fatty acids in the presence of a metal initiator such as cupric nitrate; and minor amounts of fuel oil, all in an aqueous phase are also present. The ground coal so treated is made hydrophobic and oleophilic and is separated from the unwanted ash and sulfur by a froth flotation technique.

The cleaned coal recovered from the preferred chemical treatment process, now in the form of beneficiated coal particles, is suited for the coal-aqueous mixtures of the invention. These coal particles are characterized by having an ash content reduced to levels of about 0.5 to 6.0% and a sulfur content reduced to levels of about 0.5 to 2.0%.

As in said U.S. Ser. No. 230,062, filed Jan. 29, 1981, (now U.S. Pat. No. 4,358,293)), it is preferred herein to form the coal-aqueous mixtures by first adding the surfactant to water together with other additives such as conventional defoaming agents, if desired. This admixing can be done with stirring at conditions of atmospheric or nearly atmospheric temperature and pressure. Thereafter, the particulate coal, preferably beneficiated coal particles, is added to the mixture to produce a coal-aqueous mixture of high coal solids content of about 45 to 80% by weight coal, based on the total weight of the mixture at atmospheric or nearly atmospheric temperatures and pressures. If desired, thickeners can then be added to further stabilize the mixture to assist in preventing the coal particles from settling when the mixture is to be stored for extended periods. Caustic soda or other bases can also be added at this point. As will be apparent, adding thickeners in or near the final stage is preferred so that the stirring requirements are kept at a minimum. The coal-aqueous mixtures can be prepared in a batch operation or in the continuous mode. In continuous production, the coal can be admixed with water in a first stage along with other flow control agents such as the surfactant. The compositions of the first stage can then be transferred continuously to a second stage wherein the thickener is added. Again, adding the thickener at the later stage results in reduced stirring requirements.

A preferred method of the preparing coal aqueous mixtures of the present invention is disclosed in afore-mentioned copending U.S. Ser. No. 416,606. More particularly, the preferred method involves first adding surfactant and other additives, such as conventional defoaming agent, if desired, to water and mixing, under low speed agitation conditions, such as at from about 500 rpm to about 1500 rpm, preferably about 1000 rpm, for a time of from about 30 seconds to about 3 minutes, preferably about 1 minute. Thereafter, the particulate coal, preferably beneficiated coal particles in the particle size distribution of the present invention, is added to the mixture and admixed therein under moderate or medium agitation conditions, for example, at an rpm in the range of from about 1000 rpm to about 3000 rpm, preferably about 2000 rpm for a time sufficient to provide a wetted out admixture. Usually this time is in the range of from about 5 minutes to about 20 minutes. At this time, the agitation of the admixture is increased to a high speed, for example, from above about 3000 rpm to about 6000 rpm, preferably about 4000 rpm for a time sufficient to disperse the coal, usually from about 5 minutes to about 15 minutes, preferably about 10 minutes. If desired, thickeners are then added to the slurry under the afore-described high speed agitation conditions, e.g. 4000 rpm, for a further time of from about 1 minutes to about 3 minutes, preferably about 2 minutes. In the preparation of a most preferred formulation, other ingredients, such as viscosity stabilizers and antibacterial agents are then added to the formulation at high speed agitation for a further time of from about 1 minute to about 3 minutes, preferably about 2 minutes. By wetted out or wet as used herein, it is meant that the surface of each coal particle is covered with water.

Typical mixing or dispersing apparatus employed herein include for example Premier Mill Co.'s Hi-Vispersator High-Speed Disperser.

As indicated above, additives that can be added to the coal-aqueous mixture include defoaming agents, thickeners, salts, bases, other flow modifying agent and combinations of these materials.

Generally, the defoaming agents that can be used are conventional and include both silicon and nonsilicon containing compositions. A commercially available defoaming agent suitable for use in the mixtures is COLLOID 691, supplied by Colloids, Inc. This composition generally comprises a mixture containing mineral oil, amide and an ester.

Thickeners can also be added to the mixture. They are added to increase the non-settling characteristics of the composition. Suitable thickeners include, for example, xanthan gum, guar gum, glue and the like. Other thickeners include, for example, alkali soluble acrylic polymers (e.g. ACRYSOL ICS-1 sold by Rohm and Haas Company). Combinations of these thickeners are also contemplated herein. For the purposes herein, the thickeners are generally used in amounts ranging from about 0.01 to about 3.0% by weight, based on the total weight of the mixture.

In preparing the compositions containing the preferred 70% to 74% by weight coal, based on the weight of the total mixture, the polyalkyleneoxide nonionic surfactants are preferably mixed with water in a proportion of about 0.3 part by weight surfactant to 29.3 parts by weight, water at atmospheric or nearly atmospheric temperatures and pressures. A defoaming agent is also added to the water in an amount of about 0.03, part by weight, to assist in processing. The pulverized coal (in the particle size distribution disclosed hereinbefore) is then mixed with the water in a proportion of 70 parts by weight coal to 29.3 parts by weight of water to obtain a flowable liquid. If desired, to the mixture can then be added about 0.12 to about 0.15, part by weight, of thickener or thickeners to provide protection against settling. Other additives such as salts or bases, antibacterial agents such as formaldehyde, and the like, viscosity stabilizers, such as ammonia, etc. can also be added in about 0.2 to about 0.3, part by weight, of the total mixture to further assist in dispersing the coal and providing the other obvious advantages.

It is also contemplated herein to utilize a combined surfactant, namely the afore-disclosed nonionic surfactants and a polyelectrolyte surfactant such as an oligomeric anionic polyacrylate surfactant, as disclosed in copending U.S. application Ser. No. 495,628, filed concurrently herewith and incorporated by reference herein.

The following Examples will further illustrate the invention:

TABLE 1

| Example No. | | 1 | 2 | 3 | 4 | 5 | 6 | 7 |
|---|---|---|---|---|---|---|---|---|
| % Weight U.S. Mesh | | | | | | | | |
| −60, +100 | | 0 | 0 | 0 | 5 | 5 | 5 | 10 |
| −100, +200 | | 35 | 30 | 25 | 30 | 25 | 20 | 30 |
| −200, +325 | | 35 | 30 | 25 | 35 | 30 | 25 | 30 |
| −325 | | 30 | 40 | 50 | 30 | 40 | 50 | 30 |
| % Solids | | 70.2 | 71.8 | 71.9 | 72.4 | 71.3 | 72.4 | 72.3 |
| Base | 10 RPM | 600 | 1200 | 1800 | 1600 | 2500 | 1600 | 550 |
| Viscosity cP | 100 RPM | 520 | 850 | 850 | 950 | 1000 | 890 | 560 |
| Viscosity After Thickener | 10 RPM | 16,500 | 12,500 | 23,000 | 26,000 | 24,600 | 30,400 | 9600 |
| | 100 RPM | 6400 | 5500 | 7400 | 8200 | 8550 | 9950 | 5170 |
| 3 Day | 10 RPM | 19,100 | 13,000 | 24,500 | 25,200 | 25,100 | 29,200 | 12,000 |
| Viscosity | 100 RPM | 8550 | 6400 | 9900 | >10,000 | 9100 | >10,000 | 6170 |
| Adjusted % Solids | | | | 70.9 | 71.4 | 70.3 | 71.4 | |
| Adjusted | 10 RPM | | | 20,000 | 20,000 | 18,000 | 20,000 | |
| Viscosity | 100 RPM | | | 7000 | 7900 | 5830 | 7200 | |
| 1 Week | 10 RPM | 18,000 | 15,000 | 21,000 | 20,000 | 23,000 | 24,000 | 12,800 |
| Viscosity | 100 RPM | 7000 | 6150 | 7200 | 7600 | 7000 | 7700 | 5500 |
| 3 Week | 10 RPM | 20,500 | 32,500 | 42,000 | 33,000 | 36,000 | 44,000 | 19,500 |
| Viscosity | 100 RPM | 7900 | >10,000 | >10,000 | >10,000 | >10,000 | >10,000 | 7800 |

| Example No. | 8 | 9 | 10 | 11 | 12 | 13 | 14 | 15 |
|---|---|---|---|---|---|---|---|---|
| % Weight U.S. Mesh | | | | | | | | |

TABLE 1-continued

| | | | | | | | | | |
|---|---|---|---|---|---|---|---|---|---|
| −60 +100 | | 10 | 10 | 15 | 15 | 15 | 20 | 20 | 20 |
| −100, +200 | | 25 | 20 | 25 | 20 | 15 | 25 | 20 | 15 |
| −200, +325 | | 25 | 20 | 30 | 25 | 20 | 25 | 20 | 15 |
| −325 | | 40 | 50 | 30 | 40 | 50 | 30 | 40 | 50 |
| % Solids | | 72.6 | 72.5 | 72.9 | 72.8 | 73.9 | 74.4 | 73.5 | 73.9 |
| Base | 10 RPM | 700 | 1500 | 900 | 750 | 1200 | 800 | 900 | 750 |
| Viscosity | 100 RPM | 550 | 770 | 660 | 600 | 800 | 640 | 560 | 550 |
| cP | | | | | | | | | |
| Viscosity | 10 RPM | 13,600 | 18,600 | 19,300 | 14,400 | 18,500 | 12,200 | 8600 | 11,500 |
| After | 100 RPM | 5590 | 7550 | 7550 | 5800 | 6900 | 5350 | 3760 | 4600 |
| Thickener | | | | | | | | | |
| 3 Day | 10 RPM | 17,000 | 18,000 | 25,500 | 15,500 | 18,000 | 18,600 | 12,000 | 12,000 |
| Viscosity | 100 RPM | 7070 | 7950 | 9850 | 6650 | 7550 | 7680 | 5100 | 5340 |
| Adjusted % Solids | | | | 71.9 | | | | | |
| Adjusted | 10 RPM | | | | 17,000 | | | | |
| Viscosity | 100 RPM | | | 6820 | | | | | |
| 1 Week | 10 RPM | 18,000 | 24,000 | 19,500 | 16,000 | 18,800 | 19,000 | 12,500 | 12,000 |
| Viscosity | 100 RPM | 6500 | 7900 | 7200 | 6800 | 7300 | 6700 | 4900 | 5000 |
| 3 Week | 10 RPM | 22,000 | 46,000 | 25,000 | 21,000 | 41,000 | 25,000 | 16,000 | 16,000 |
| Viscosity | 100 RPM | 8500 | >10,000 | 9100 | 8900 | >10,000 | 8800 | 6200 | 6700 |

Each of the Examples in the Table contain the following ingredients:

| Ingredient | Material | Parts by Weight |
|---|---|---|
| 1 | Water | from about 25 to about 29 (adjusted according to coal content) |
| 2 | Tetronic 1307 | from about .34 to about .36 |
| 3 | Colloid 691 | .03 |
| 4 | Cleancoal | from about 70 to about 74 |
| 5 | Kelzan | .014 |
| 6 | Guar THIX | .10 |
| 7 | 37% Formaldehyde | .14 |
| 8 | 28% Ammonia | .14 |

1 Industrial Water
2 Surfactant - BASF Wyandotte Corp.
3 Anti-foam Agent - Colloids, Inc.
4 Pocahontas Clean Coal
5 Xanthan Gum - Kelco Division, Merck & Co., Inc.
6 Guar Gum - Hercules, Inc.
7 Formaldehyde Solution - Borden Chemicals
8 Ammonium Hydroxide - Fischer Scientific An examination of the data shows that the solids of the slurries was increased from about 71% to 74% by increasing the coarse fraction (−60 +100 mesh) of the size consist from 0% to 20%.

Having fully described an embodiment of the foregoing invention, it is to be understood that this description is offered by way of illustration only. The range of adaptability of the invention presented herein is contemplated to include many variations and adaptations of the subject matter within the scope of the production of coal-aqueous mixtures. And it is to be understood that this invention is to be limited only by the scope of the appended claims.

I claim:

1. A stabilized, high solids content coal-aqueous mixture comprising particulate coal as a dispersed solid material; water as a carrier medium; and a polyalkyleneoxide nonionic surfactant having a hydrophobic portion and a hydrophilic portion, said hydrophilic portion comprising at least about 100 units of ethylene oxide, wherein said particulate coal has the following particle size distribution:

| mesh (Tyler Standard screen size) | % weight based on total dry coal |
|---|---|
| −60, +100 | 5-20 |
| −100, +200 | 15-30 |
| −200, +325 | 15-30 |

-continued

| mesh (Tyler Standard screen size) | % weight based on total dry coal |
|---|---|
| −325 | 30-50 |

2. The stabilized, high solids content coal-aqueous mixture of claim 1 wherein said particulate coal has the following particle size distribution:

| mesh (Tyler Standard screen size) | % weight of coal particle blend |
|---|---|
| −60, +100 | 15-20 |
| −100, +200 | 20-25 |
| −200, +325 | 20-25 |
| −325 | 30-40 |

3. The stabilized, high solids content coal-aqueous mixture of claim 1 further comprises a thickening agent.

4. The stabilized, high solids content coal-aqueous mixture of claim 1 further comprising an anti-foam agent.

5. The stabilized, high solids content coal-aqueous mixture of claim 1 further comprising a thickening agent and an anti-foam agent.

6. The stabilized high solids content coal-aqueous mixture of claim 1 wherein said polyalkyleneoxide nonionic surfactant has a high molecular weight at least about 4000.

7. The stabilized, high solids content coal-aqueous mixture of claim 1 wherein said polyalkyleneoxide nonionic surfactant comprises a composition of the formula

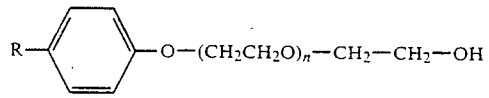

wherein R is substituted or unsubstituted alkyl of from 1 to 18 carbon atoms; substituted or unsubstituted aryl or an amino group, and n is an integer of at least about 100.

8. The stabilized, high solids content coal-aqueous mixture of claim 7 wherein R is a nonyl.

9. The stabilized, high solids content coal-aqueous mixture of claim 7 wherein said polyalkyleneoxide nonionic surfactant has a molecular weight of at least about 4000.

10. The stabilized, high solids content coal-aqueous mixture of claim 1 wherein said polyalkyleneoxide nonionic surfactant comprises a composition of the formula $$HO(CH_2CH_2O)_a[CH(CH_3)CH_2O]_b(CH_2CH_2O)_3H$$

wherein a, b and c are whole integers and a and c total at least about 100.

11. The stabilized, high solids content coal-aqueous mixture of claim 10 wherein said polyalkyleneoxide nonionic surfactant has a molecular weight of at least about 6000.

12. The stabilized, high solids content coal-aqueous mixture of claim 1 wherein said polyalkyleneoxide nonionic surfactant comprises a composition of the formula

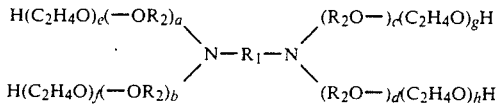

wherein $R_1$ is an alkylene radical having 2 to 5 carbon atoms; $R_2$ is an alkylene radical having 3 to 5 carbon atoms; a, b, c, d, e, f, g and h are whole integers and e, f, g and h total at least about 100.

13. The stabilized, high solids content coal-aqueous mixture of claim 12 wherein $R_1$ is an alkylene radical having 2 carbon atoms and $R_2$ is an alkylene radical having 3 carbon atoms.

14. The stabilized, high solids content coal-aqueous mixture of claim 1 further comprises a viscosity stabilizer.

15. The stabilized high solids content coal-aqueous mixture of claim 1 further comprising an oligomeric anionic polyacrylate surfactant.

* * * * *